US005458041A

United States Patent [19]

Sun et al.

[11] Patent Number: 5,458,041

[45] Date of Patent: Oct. 17, 1995

[54] AIR DEFENSE DESTRUCTION MISSILE WEAPON SYSTEM

[75] Inventors: John Sun, Thousand Oaks; Ross J. Sanders, Newbury Park; Ralph C. Starace, Camarillo; William K. Hackman, Thousand Oaks, all of Calif.

[73] Assignee: Northrop Grumman Corporation, Los Angeles, Calif.

[21] Appl. No.: 284,875

[22] Filed: Aug. 2, 1994

[51] Int. Cl.[6] ..... F41G 7/00

[52] U.S. Cl. ..... 89/1.11; 244/3.11; 244/3.16; 244/3.19

[58] Field of Search ..... 89/1.11; 244/3.11, 244/3.12, 3.14, 3.16, 3.19; 342/25, 53, 54

[56] References Cited

U.S. PATENT DOCUMENTS

| | | | |
|---|---|---|---|
| H796 | 7/1990 | Miller, Jr. et al. | 244/3.17 |
| 3,798,647 | 3/1974 | Bailey | 343/112 D |
| 4,050,068 | 9/1977 | Berg et al. | 343/6 R |
| 4,247,942 | 1/1981 | Hauer | 375/25 |
| 4,281,809 | 8/1981 | Oglesby et al. | 244/3.16 |
| 4,357,611 | 11/1982 | Skomal | 343/18 C |
| 4,477,814 | 10/1984 | Brumbaugh et al. | 342/53 |
| 4,637,571 | 1/1987 | Holder et al. | 244/3.16 |
| 4,700,190 | 10/1987 | Harrington | 342/2 |
| 4,709,235 | 11/1987 | Graham, Jr. et al. | 342/10 |
| 4,796,834 | 1/1989 | Ahlström | 244/3.16 |
| 5,004,185 | 4/1991 | Lockhart, Jr. et al. | 224/3.14 |
| 5,035,375 | 7/1991 | Friedenthal et al. | 244/3.12 |
| 5,061,930 | 10/1991 | Nathanson et al. | 342/13 |
| 5,129,595 | 7/1992 | Thiede et al. | 244/3.16 |
| 5,182,564 | 1/1993 | Burkett et al. | 342/53 |
| 5,273,236 | 12/1993 | Wootton et al. | 244/3.11 |
| 5,308,984 | 5/1994 | Slawsby et al. | 342/53 |
| 5,310,134 | 5/1994 | Hsu et al. | 244/3.12 |
| 5,340,056 | 8/1994 | Guelman et al. | 244/3.16 |
| 5,350,134 | 9/1994 | Crawford | 244/3.16 |
| 5,365,236 | 11/1994 | Fagarasan et al. | 342/53 |

*Primary Examiner*—Charles T. Jordan
*Assistant Examiner*—Theresa M. Wesson
*Attorney, Agent, or Firm*—Terry J. Anderson; Karl J. Hoch, Jr.

[57] ABSTRACT

An air defense missile weapon system in which a plurality of unmanned missiles penetrate, survey, identify, attack and destroy target areas that include air defense sites and sites of military interest. Each of the missiles has an airframe, sensors, data links, propulsion means, and a plurality of control surfaces. The missiles are launched from a carrier aircraft towards the target sites from a stand-off range. The missiles preferably operate in cooperative teams of hunter and killer missiles, and are interoperable with a plurality of military aircraft and other existing weapon systems.

17 Claims, 6 Drawing Sheets

AIR DEFENSE DESTRUCTION MISSILE WEAPON SYSTEM

BACKGROUND OF THE INVENTION

1. Field of the Invention

This invention relates generally to a missile weapon system for the surveillance and suppression of an enemy's air defense sites or other types of sites of military interest.

2. Description of the Related Art

In modern day warfare, air supremacy is critical to accomplish battlefield objectives. The suppression of an enemy's air defenses is of paramount importance if air supremacy is to be achieved. A number of individual weapons have been developed for this purpose.

For example, U.S. Pat. No. 4,281,809 to Oglesby et al. discloses a method for precision bombing a plurality of targets using a precision guided weapon to dispense homing beacons prior to attacking a prime target for guiding other weapons to attack secondary targets by homing on the dispensed beacons.

And, U.S. Pat. No. 4,050,068 to Berg et al. discloses an optical tracker with a radar sensor to lock on to and track a moving target aircraft. U.S. Pat. No. 5,035,373 to Friedenthal et al. discloses a fiber optic system for a radar guided missile.

U.S. Pat. No. 4,637,571 to Holder et al. discloses a system for image stabilization in an optical guidance system.

U.S. Pat. No. 5,061,930 to Nathanson et al., U.S. Pat. No. 5,129,595 to Thiede et al., and U.S. Statutory Invention Registration H796 to Miller, Jr., et al. all disclose various seeker systems for missiles.

U.S. Pat. No. 5,004,185 to Lockhart, Jr., et al. discloses an aircraft and missile data link system, and U.S. Pat. No. 4,247,942 to Hauer discloses a jam resistant communication system for control of aircraft and missiles.

U.S. Pat. Nos. 4,357,611 to Skomal and 4,700,190 to Harrington disclose devices for enhancing and augmenting the radar cross section of missile reentry vehicles, and U.S. Pat. No. 4,709,235 to Graham, Jr., et al. discloses an aircraft-launched, inflatable radar decoy.

However, there has not as yet been developed a fully integrated weapon system for the surveillance and suppression of enemy air defenses, most particularly surface-to-air missile sites.

There are two types of defensive surface-to-air missile sites that require surveillance and suppression: non-radiating sites and intermittently radiating sites. Also, the present High Speed Anti-Radiation Missile (HARM) is designed for the destruction of a radiating radar antenna only, and is not therefore effective for the destruction of an entire missile site or other sites of military interest. No existing weapon system is capable of concurrently searching for, surveying, identifying, and destroying radar antennas, missile launchers, and support equipment and facilities for both types of missile sites.

There exists, therefore, a significant need for an improved air defense destruction missile weapon system which is fully integrated and specifically designed to accomplish the destruction of an entire missile site of an enemy's air defenses. The present invention fulfills these needs and provides further related advantages such as high attitude surveillance and interoperability capability with other combat aircraft performing air defense suppression missions.

SUMMARY OF THE INVENTION

In accordance with the invention, an air defense destruction missile weapon system is provided which includes a plurality of air defense destruction missiles, each having an airframe, propulsion means, and a plurality of control surfaces. The missiles are carried on aircraft and are launched from stand-off range toward the air defense site targets. Each missile also includes a radio frequency direction finder, an imaging infrared seeker system with automatic target cuing algorithms, a Global Positioning System locating system, a jam-resistant missile-to-aircraft data link, a radar cross section augmentation system, and a warhead to enable the missile to perform a variety of air defense destruction missions. Among the missions to be accomplished are a pre-briefed mode in which the precise location of the target is known, a pre-emptive mode in which the general target area such as an attack corridor is known, a target-of-opportunity mode in which the missile is redirected during transit towards a target encountered while en route, and a self-protection mode for the launch aircraft.

In one embodiment, a number of the missiles are "smart" high-cost hunter missiles while other less sophisticated, lower cost missiles serve as killer missiles. The hunter missile provides for target surveillance, search, data link transmission of mission data and, battle damage assessment information, and residual target destruction. The low-cost killer missiles provide decoy capability to stimulate enemy radar emissions in addition to the primary function of attacking and destroying enemy targets.

In a further embodiment, the hunter and killer missiles are deployed in cooperating teams with the hunter missiles operating at a high altitude for surveillance and the killer missiles at a lower altitude for searching and attacking air defense site targets or other types of sites of military interest.

Existing missile systems that are capable of sustained cruise, surveillance, loitering, or gliding can be modified to perform some or all of the functions of the missile components of the air defense destruction missile weapon system. Also, the air defense destruction missile weapon system can be utilized interoperably with other weapon systems such as fighter/attack aircraft which can engage and destroy enemy air defense targets.

Other features and advantages of the present invention will become apparent from the following detailed description, taken in conjunction with the accompanying drawings which illustrate, by way of example, the principles of the invention.

BRIEF DESCRIPTION OF THE DRAWINGS

The accompanying drawings illustrate the present invention. In such drawings.

DETAILED DESCRIPTION OF THE PREFERRED EMBODIMENTS

1. BASIC EMBODIMENT

Figure 1:
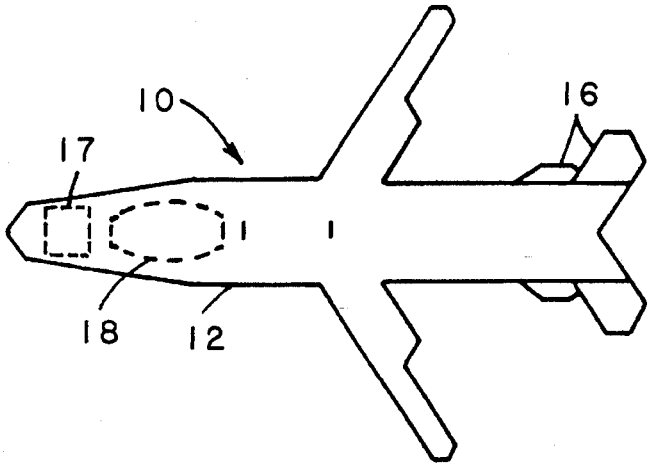
FIG. 1 is a top plan view of a missile of the present invention.
Figure 2:
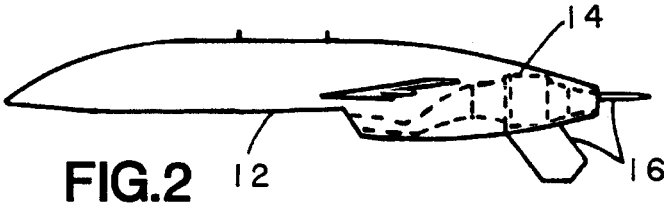
FIG. 2 is a side elevation view of the missile shown in FIG. 1.
Figure 3:
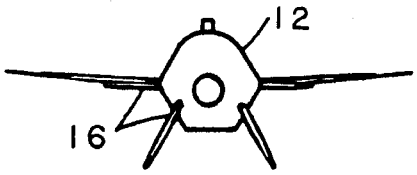
FIG. 3 is a rear elevation view of the missile shown in FIG. 1.

FIGS. 1–3 generally illustrate a missile 10 of the present invention. The missile 10 generally comprises a low observable airframe 12 powered by a turbojet engine 14 (shown in FIG. 2). A plurality of fixed, pre-deployed missile control surfaces 16 are positioned on the airframe 12 to control the flight of the missile 10. The airframe 12 includes an electronics suite 17 comprising a seeker having a radio frequency direction finder, an imaging infrared system with automatic target cuing algorithms, a Global Positioning System locating system, a jam-resistant missile-to-aircraft data link system, a radar cross section augmentation system, and further includes a warhead 18. Warhead 18 is preferably a fragmentation warhead or comparable type of conventional, i.e. non-nuclear, warhead selectively optimized for the engagement of specific targets.

The missile 10 is launched from either fighter or bomber aircraft at a stand-off distance from the target. Launch from a stand-off distance of one hundred nautical miles or more from the selected target is possible using the basic airframe design of missile 10.

Figure 4:
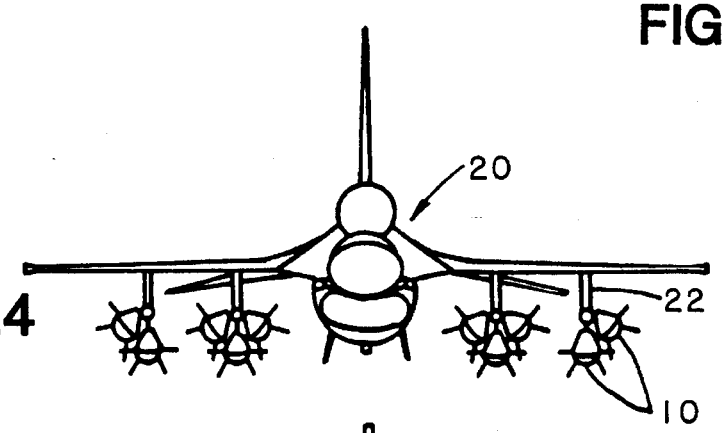
FIG. 4 is a front elevation view of a carrier aircraft equipped with missiles of the present invention.
Figure 5:
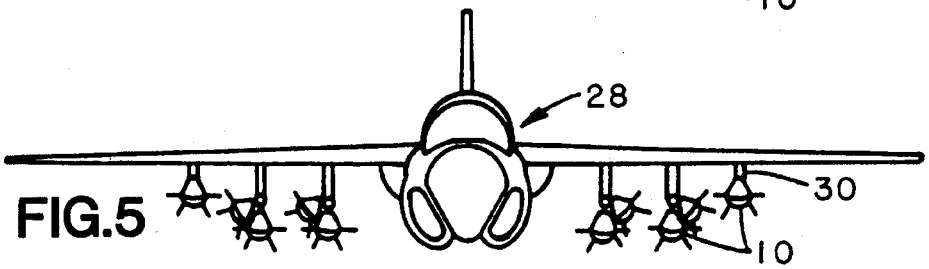
FIG. 5 is a front elevation view of another carrier aircraft equipped with missiles of the present invention.
Figure 6:
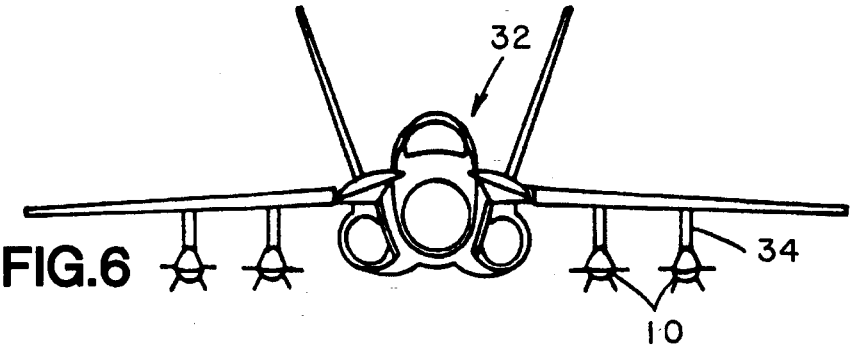
FIG. 6 is a front elevation view of a third carrier aircraft equipped with missiles of the present invention.

Some of the existing military aircraft which can be employed to launch missiles 10 of the present invention are illustrated in FIGS. 4–6. For example, ten missiles 10 of the present invention are shown carried on triple ejector racks 22 of F-16 aircraft 20 as shown in FIG. 4. Twenty missiles 10 are shown loaded in tandem on the multiple ejector racks 30 of A-6F aircraft 28 as shown in FIG. 5. Vertical ejector racks 34 are utilized to load four missiles 10 on F/A-18 aircraft 32 as is illustrated in FIG. 6. Existing B-52, B-1, and B-2 bomber aircraft can also be equipped with missiles 10 using comparable ejector racks adapted for these aircraft, and the invention will be understood to be readily adapted to other current military aircraft or future such aircraft which may be developed through use of similar ejector racks, munitions storage and dispensing means, and ordnance release systems.

The missile 10 is preferably designed for operator-controlled destruction of all of an enemy air defense site, including surface-to-air missile system structures, support equipment, and facilities such as control centers or other sites of military interest. It operates in a wide variety of mission environments and has the capability to destroy non-emitting targets, to operate autonomously or in response to commands from a pilot or weapon operator, and to collect and transmit information concerning battle damage assessment, i.e. the extent of target destruction, to the pilot or weapon operator or other battle staff personnel. The non-emitting targets which can be destroyed by the present invention include both stationary and mobile missile sites with inactive radar emitters.

Figure 7:
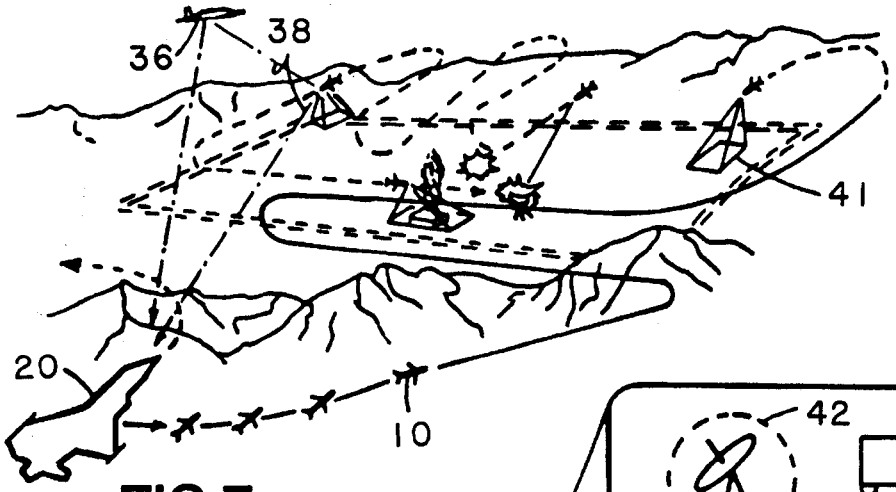
FIG. 7 is a perspective view of a pre-briefed mission of the weapon system of the present invention.

FIG. 7 illustrates an embodiment of the present invention in which the missiles 10 operate in an externally cued, or pre-briefed, mission mode.

In the pre-briefed mission mode, accurate Global Positioning System coordinates for the target air defense site are known and are provided to the missiles 10 by missile targeting personnel on the ground prior to take-off of the carrier aircraft, shown as for example F-16 aircraft 20, or by the pilot or weapon operator during flight. In FIG. 7, the target location is shown as being provided to the crew of aircraft 20 from the Joint Surveillance Target Attack Radar System (J-STARS) aircraft 36 which is operating at an altitude and distance from the target sufficient to ensure that the aircraft 36 is not itself within range of the air defense weapons of the target site. It will be understood that the target location can be provided from any suitable source, such as the Airborne Warning and Control System (AWACS) aircraft or real time communications from other surveillance aircraft or attack aircraft.

After being launched from the aircraft 20 at the stand-off position, one or more of the missiles 10 deploys to the preloaded coordinates of their respective targets. As the missiles 10 enter the target area, their imaging infrared seeker data is transmitted in real time back to the aircraft 20 and to other attacking aircraft 20, ground units within receiving range, and airborne military command and control platforms such as J-STARS aircraft 36 by data link 38. Automatic target cuing algorithms in the seeker system operate to identify and select potential targets in the seeker field of view and prompt the pilot or weapon operator of the aircraft 20 to designate specific targets in the target area for attack.

Figure 8:
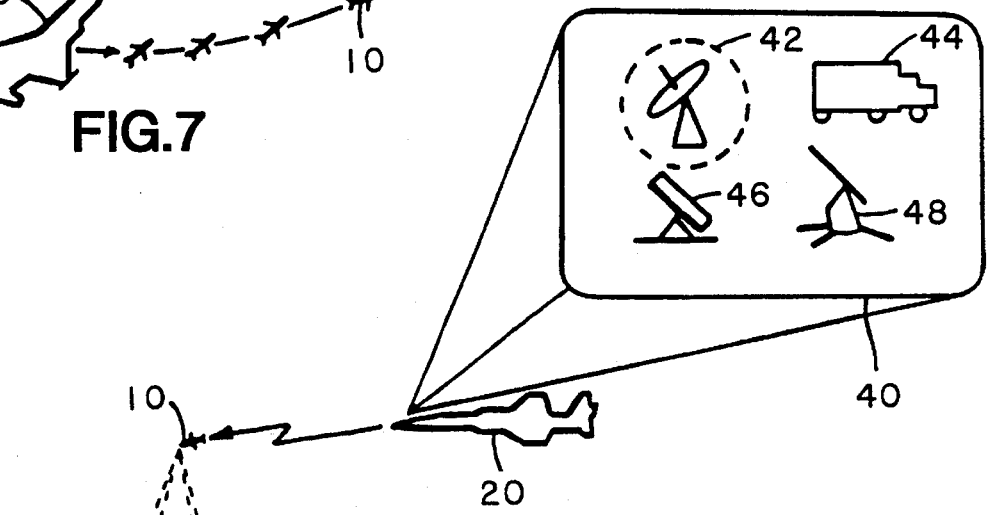
FIG. 8 is an exploded view of a cockpit console display showing pictorial representations for typical categories of targets to be destroyed by the present invention.

The cockpit console display 40 for aircraft 20 is shown in FIG. 8 and illustrates pictorial representations for typical categories of the target structures and equipment associated with an air defense site, as for example radar 42, control van 44, power source 46, and missile launcher 48. Using the imaging infrared seeker field of view 41, the missiles 10 search the target area and transmit seeker data on potential targets back to the pilot or weapon operator of aircraft 20. The pilot or weapon operator reviews the seeker data from a selected missile 10, verifies that a potential target is a proper target, and enables the selected missile 10 for attack.

The warhead 18 (FIG. 1) is adapted to provide substantial lethality against all of the typical air defense site structures displayed on cockpit console display 40, so that the pilot or weapon operator only need select, such as by input from cockpit console display 40, which target structure category (e.g., radar 42) is to be attacked. The aimpoint of the imaging infrared seeker system tracker is then automatically set within the selected missile 10 to maintain lock on the targeted structure, and the missile 10 is subsequently commanded to execute the attack.

The lookdown angle of the seeker is such that at nominal attack altitudes, such as four to five thousand feet above ground level, the attack of missile 10 commences directly upon pilot or weapon operator command. The preceding procedure is repeated as necessary for other missiles 10 in the complement of missiles 10 carried by aircraft 20 until all missiles 10 have been expended or the mission is completed.

In the pre-briefed mission mode embodiment of FIG. 7, unexpended missiles 10 can also assess battle damage inflicted by previous attacks of other missiles 10, or other weapons, using the imaging infrared seeker field of view 41 and transmitting that information back to the pilot or weapon operator of aircraft 20 and other command and control or surveillance units as applicable. The information transmitted by data link 38 is preferably recorded continuously, so that mission progress, additional target identification, designation, and attack and battle damage assessment can be accomplished on a real time ongoing basis or stored for later playback and analysis. If for any reason the data link 38 between missile 10 and aircraft 20 becomes inoperative when the missile 10 is at its designated target location, the automatic target cuing algorithm of the seeker selects a target to attack at the target area in accordance with criteria programmed into the algorithm and attacks that target.

Figure 9:
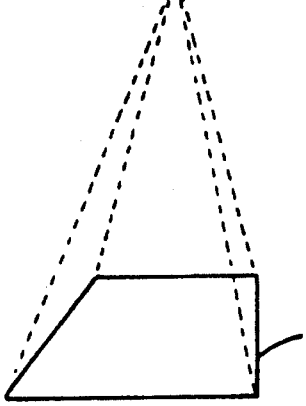
FIG. 9 is a perspective view of a pre-emptive mission of the present invention.
Figure 9:
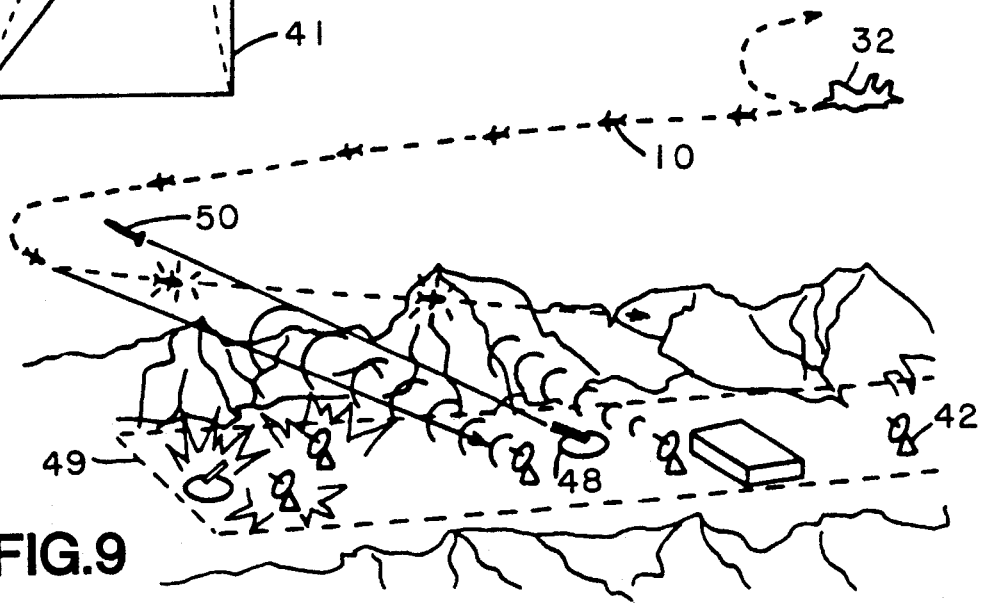

The pre-emptive mode embodiment of the invention is illustrated in FIG. 9, and is used when a specific target location is not precisely known but a general area to be attacked, such as attack corridor 49, is known. One or more missiles 10 of the invention are launched from a carrier aircraft, as for example F/A-18 aircraft 32, and deploy to the area to be attacked. Because the missiles 10 are provided with low observable technology and features, the missiles 10 have a high probability of undetected flight to the attack corridor 49.

On a predetermined number of missiles 10, the radar cross section augmentation system of each such missile 10 is activated and those missiles 10 begin maneuvers to simulate approaching attack aircraft. When the radars 42 in the attack corridor 49 activate in response to the simulated threat from the missiles 10 which have activated their augmented radar cross section systems, radars 42 are then attacked immediately by one or more of the missiles 10, or the positions of radars 42 are determined and stored for subsequent attack. The radio frequency mode of the seeker of the missiles 10 can be used to control the attack or to cue the imaging infrared seeker for target acquisition and aimpoint selection in the event a targeted radar 42 stops emitting signals in order to avoid attack.

The missiles 10 maintain the attacking and suppression of identified targets in attack corridor 49 until all deployed missiles 10 are expended or their respective fuel supply is depleted. The pre-emptive mode embodiment is preferably an autonomous mode of operation, but may alternatively be controlled by the pilot or weapon operator of aircraft 32. The autonomous mode is preferred where multiple targets are to be concurrently engaged by multiple missiles 10.

Figure 10:
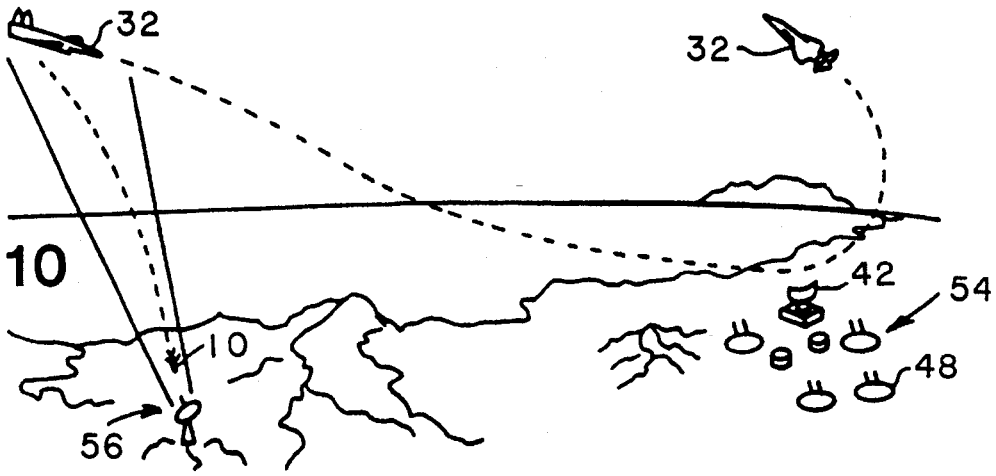
FIG. 10 is a perspective view of a target-of-opportunity mission of the present invention.

The present invention is also capable of operating in a target-of-opportunity mode embodiment as illustrated in FIG. 10. In the target-of-opportunity mode embodiment, the carrier aircraft, shown as for example the F/A-18 aircraft 32 of FIG. 6, is shown as being en route towards an intended target 54. However, FIG. 10 illustrates the situation where a target-of-opportunity 56 has been identified and selected for attack by the pilot or weapon operator of aircraft 32 before proceeding to the intended target 54. In such instance, missile 10 is launched and directed towards the target-of-opportunity 56, after which aircraft 32 proceeds on to attack intended target 54.

The target-of-opportunity mode embodiment may alternatively be viewed as an in-flight replanning mode embodiment, because target designation is accomplished by the pilot or weapon operator from the cockpit of aircraft 32 by entering in missile 10 the new set of Global Positioning System target-of-opportunity coordinates or range and bearing vectors to the target-of-opportunity 56 from the launch aircraft 32.

Figure 11:
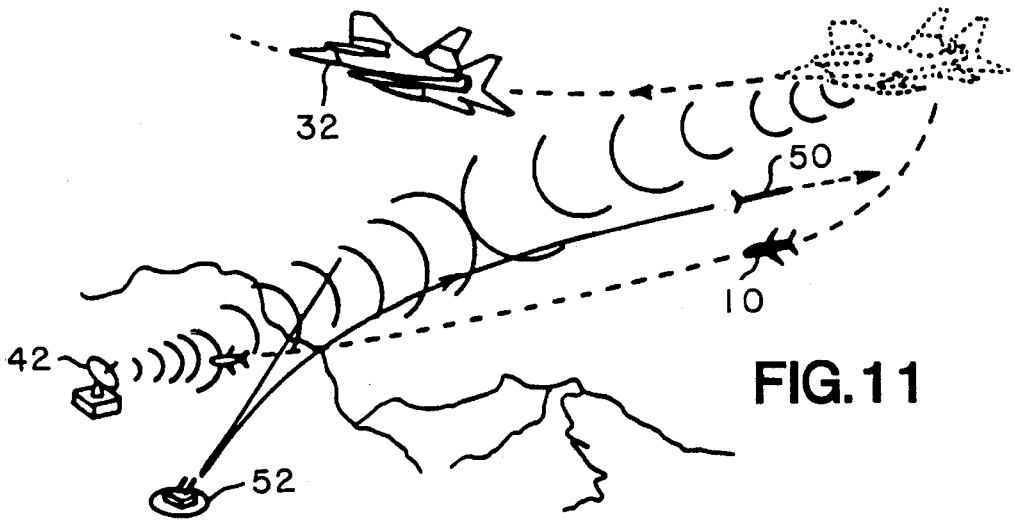
FIG. 11 is a perspective view of a self-protection mission of the of the present invention.

FIG. 11 illustrates an embodiment of the invention in which missile 10 is used in a defensive or self-protection mode to protect the carrier aircraft, shown for example as F/A-18 aircraft 32. In the embodiment of FIG. 11, the aircraft 32 is illustrated as being under attack from surface-to-air missile 50 from launcher 52 which is controlled by a radar 42 whose emissions have been detected by defensive warning systems of aircraft 32.

In the embodiment of FIG. 11, the missile 10 is illustrated as being launched with augmented radar cross section capabilities activated to confuse and misdirect attacking missiles 50 from launcher 52 to missile 10 instead of aircraft 32, allowing aircraft 32 to exit the area without damage. The augmentation system of missile 10 simulates the radar signature of the attack aircraft 32 by providing wide band amplification of incoming radar signals. In addition, and depending on the length of time that the defensive radar 42 or launcher 52 are actively emitting radio frequency signals, missile 10, although launched in a self-protection mode, could also autonomously attack and destroy the surface-to-air missile site radar 42 or launcher 52 under control of its radio frequency and imaging infrared seekers in the manner discussed for previous embodiments of the invention.

Figure 12:
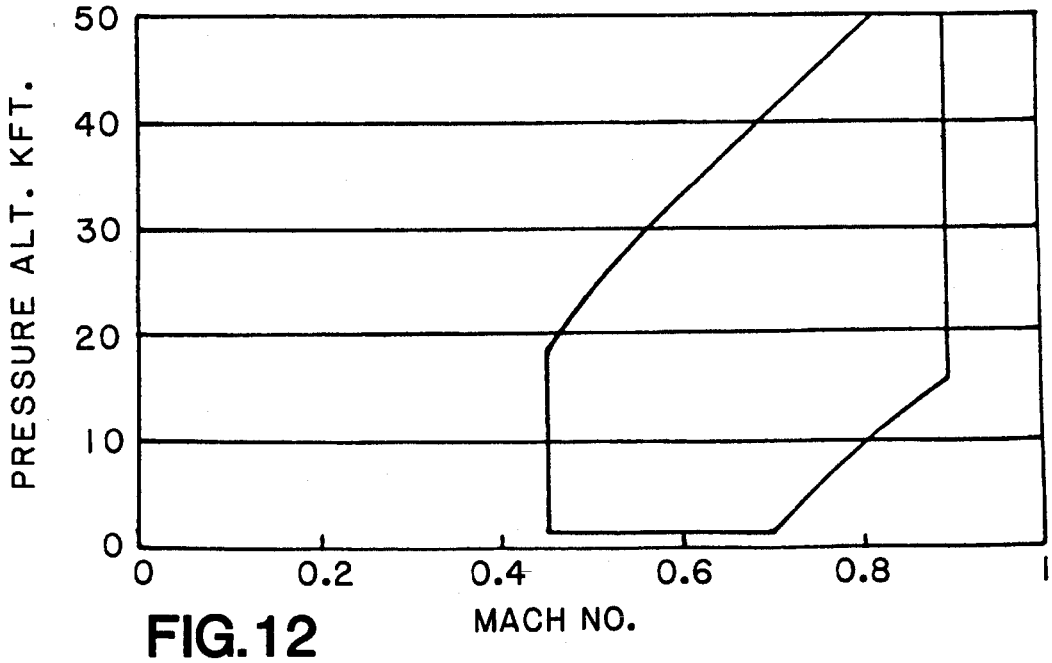
FIG. 12 is a graph of a launch envelope for the missile of the present invention.

A preferred flight envelope of acceptable altitudes and airspeeds for the missile 10 of the invention is illustrated in FIG. 12, showing Pressure Altitude in thousands of feet vs. airspeed in Mach Number.

Figure 13:
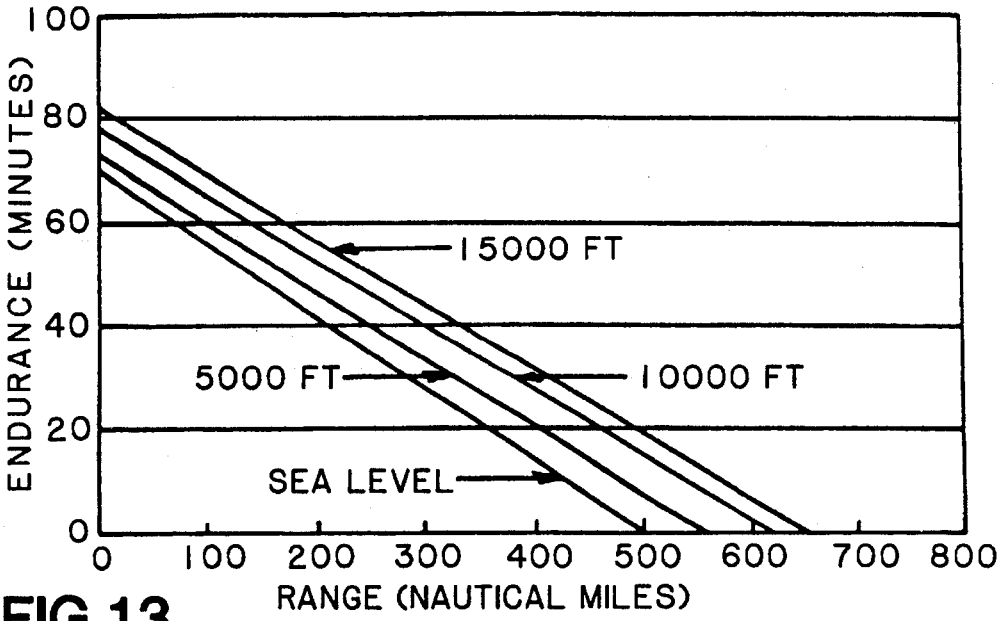
FIG. 13 is a graph showing endurance vs. range for the missile of the present invention.

FIG. 13 illustrates a graph of missile flight time, i.e. loiter or endurance time, in minutes vs. the range from launch point to target in nautical miles for selected altitudes from sea level to fifteen thousand feet. FIG. 13 assumes that a missile of the present invention is launched from a carrier aircraft in straight and level flight cruise at its best range/endurance speed and under conditions of a standard day. As would be known to those skilled in the art, the missile of the present invention can achieve substantially larger flight envelopes and endurance than that shown in FIGS. 12 and 13 by using higher aspect ratio wings, larger airframes, and advanced propulsion plants.

FIGS. 12 and 13 each present data for a missile 10 generally of about one hundred and twenty-two inches in length and having a weight of about seven hundred pounds. A smaller embodiment of missile 10 having a length of about ninety-two inches and a weight of about five hundred and fifty pounds would have a significantly shorter range, since the longer missile has greater fuel capacity for extended range.

It should be noted that the missile 10 can either be a missile of new design as depicted in FIGS. 1–3, or an existing missile capable of cruise, loitering, or gliding flight modified to accomplish the above-mentioned missions.

As previously indicated, the missile 10 can be provided a target location cue from any number of sources, including surveillance satellites. The cue will normally be a target area that is centered on the estimated target position and is large enough to have at least a ninety-five percent probability of enclosing the actual target position.

Alternately, the missile 10 can use its on board radio frequency sensor for initial target acquisition. While the missile 10 is in a radio frequency search mode, the missile's radar cross section augmentation system or the radar cross section augmentation system of an accompanying missile 10 is activated to induce radar emissions of a target radar 42. The azimuth and elevation estimates from the radio frequency direction finder together with altitude data enable the missile 10 to establish the approximate position of the target area.

In either case, if the target area is small enough to be searched by the imaging infrared sensor while diving, the missile 10 begins terminal guidance and imaging infrared search upon reaching the target area. Otherwise, the missile 10 begins a constant altitude imaging infrared search at a preselected altitude depending on imaging infrared visibility.

The imaging infrared sensor is preferably a focal plane array using a 256 by 256 picture element (pixel) detector array and a one hundred and twenty hertz frame rate for high resolution imaging. A zoom capability of the sensor optics provides each individual detector with an angular intercept of 0.4 millirads (mrad) for wide view and 0.2 mrad for narrow view. This gives the sensor a wide field of view of about 5.9 degrees in both azimuth and elevation.

In good weather, the constant altitude imaging infrared search method described above is preferably done at about five thousand feet altitude above ground level. This choice of altitude is a compromise between the increased detection and the decreased field of view that is obtained at lower altitudes. At a five thousand foot altitude and a look down angle of twenty degrees, the slant range to the target imaged by the field of view is approximately three miles. The sensor is able to image target objects at this range in clear weather. At a three mile range, the 0.2 mrad angular resolution provides approximately three feet of linear resolution. This equates to about 4×5 pixels for a typical surface-to-air missile site target object. Typical detection ranges for a signal to noise ratio of about six db, a room temperature background, and a two degrees Celsius temperature difference, are seven miles in clear weather, two miles in eight mm/hour rain, and three-tenths of a mile in fog. During low imaging infrared conditions such as rain, fog, or dust, a lower search altitude of approximately one thousand and five hundred feet above ground level is necessary for equivalent target discrimination.

During initial radio frequency acquisition in the preemptive mode embodiment, various signal parameters such as frequency, pulse repetition interval, and pulse width are used to identify the type of emitter radiating at the target site. Such parameters enable the automatic target cuing system to estimate the size, shape, and configuration of target objects such as antennas, launchers, and generators which will be attacked.

The range to the target is derived from the position geometry between the missile 10 and the target. The target range enables the automatic target cuing algorithm to correlate the estimated target size and shape with the observed size and shape of candidate targets. Non-imaging infrared techniques, in which data received through the imaging infrared sensor is spectrally analyzed, can further aid in target identification. This information simplifies the automatic target cuing process and significantly improves its probability of successful target identification.

The missile 10 has a video data link that transmits the on-board imaging sensor images to a manned control center, such as the carrier aircraft cockpit, for examination. The missile 10 target recognition capability sorts and preselects the sensor images for potential targets and relays only those images that contain objects having a high probability of being a valid target. The human operator in the control center, the pilot for example, selects a target from the presented group of high probability candidate targets, and the displayed target image is scrolled as the missile 10 searches the target region with the automatic target cuing feature highlighting potential targets for closer inspection.

At five thousand feet above ground level and a twenty degree look down angle, the imaging infrared sensor's field of view is about one thousand and five hundred feet wide and about four thousand and four hundred feet long. At a missile velocity of about five hundred feet per second, a potential target object will thus be displayed for about nine seconds. During this time the pilot initially selects a primary target from among the highlighted potential target objects. The imaging infrared sensor then enters a high resolution operating mode and begins tracking the selected target object. These conditions provide the pilot or weapon operator of the attack aircraft sufficient time and image resolution capability to verify the target for subsequent attack by the missile 10.

In order to search a large area with its field of view, the imaging infrared sensor performs an azimuth sweep while searching. The sweep rate is preferably limited to about one pixel (i.e. 0.4 mrad) or less of angular motion during the sensor image frame period (about 1/120th of a second) to preclude image blurring. This limits the sweep rate to a maximum of about three degrees per second.

To avoid gaps in the search pattern, each azimuth sweep must be completed before movement of the missile 10 has translated the sensor field of view by a distance which is greater than the length of the sensor field of view footprint, which as noted above is about four thousand and four hundred feet. At a missile velocity of about five hundred feet per second, an azimuthal sweep time of about nine seconds or less is therefore required. At a preferred sweep rate of two degrees per second, such a sweep time equates to eighteen degrees of azimuth sweep, which provides a satisfactory single pass search width of four thousand and five hundred feet.

After target confirmation by the pilot or weapon operator of the carrier aircraft, the missile 10 commences to attack the target using imaging infrared sensor data for terminal guidance. If the missile 10 cannot immediately attack the confirmed target, the stored Global Positioning System coordinates and target imagery allow the missile 10 or other weaponry to attack the target at a later time.

As previously indicated, the missile 10 has three different modes of target acquisition, namely: search while diving; constant search at high altitude; and constant search at low altitude.

The search while diving mode is used when the target location region is small enough to be searched by the imaging infrared sensor during the terminal dive of the missile 10, or when the radio frequency signal from the target is being emitted. In such conditions, the missile 10 flies directly to the target region and initiates a pitch over maneuver to dive on the target. While diving, the imaging infrared sensor searches the target region and, when it acquires the target, terminal guidance is switched to imaging infrared so that a cessation of radio frequency emissions will not thwart the attack.

Assuming a missile 10 velocity of five hundred feet per second and a pre-attack altitude of ten thousand feet above the target, the missile 10 will require about thirty seconds to complete the dive to the target. For an ingress distance of forty miles, the ingress to the target would require about four hundred and twenty seconds, so that a total mission time from launch of missile 10 to impact on the target of about four hundred and fifty seconds results.

The constant search at high altitude mode is used in conditions of good infrared visibility when the target region is too large to be searched during the terminal attack dive.

In the constant search at high altitude mode, the missile 10 descends from its release altitude from the carrier aircraft to about five thousand feet above ground level and flies to the estimated target location to begin searching. At a missile speed of five hundred feet per second, a 1 mile ×0.5 mile target region can be searched in one pass lasting about ten seconds. Each potential target object to be inspected by the pilot or weapon operator for possible attack is estimated to require about five seconds of tracking. Target verification by the pilot or weapon operator should optimally require no more than five inspections before a target is confirmed, resulting in a total target acquisition time of thirty-five seconds. The terminal attack dive from five thousand feet to target impact is estimated to take about fifteen seconds. Assuming as before a forty mile ingress distance and a four hundred and twenty second ingress time, a total mission time of four hundred and seventy seconds is derived.

When adverse environmental conditions such as fog, rain, or dust obscure objects on the ground from the imaging infrared sensor at the high altitude search altitude of five thousand feet, the constant search at low altitude mode is used. At one thousand and five hundred feet above ground level, the imaging infrared sensor can readily image objects on the ground even through fog and rain, but this altitude is too low to permit an effective terminal dive attack maneuver.

In such cases, when the target is located by the imaging infrared sensor and confirmed by the pilot or weapon operator, the missile 10 employs its own position known from the Global Positioning System locating system along with the pointing angles to the target provided by the missile 10's imaging infrared sensor to determine the target location. The missile 10 then initiates a climb to such an altitude as will provide for an accurate terminal dive. Since the imaging infrared sensor may often be unable to retain a sensor lock on the target during the climb maneuver, the terminal dive on the target is preferably initiated using the Global Positioning System target position determination.

Although the Global Positioning System position determination is sufficient to complete the attack, the imaging infrared sensor attempts to reacquire the target during the terminal dive in order to provide the most accurate terminal guidance to the target which can be achieved.

At one thousand and five hundred feet above ground level, the imaging infrared sensor's field of view is about one-third the size of the sensor field of view at five thousand feet above ground level. Thus, a complete search of a 1 mile ×0.5 mile target region requires at least three passes over the target region. On average, it is believed that the target should be acquired after only about one and a half passes.

Thus, it is estimated that an average target acquisition time for the low altitude search mode is about fifty-five seconds of search time and an additional thirty seconds for one turn to commence the second pass, for a total target acquisition time of eighty-five seconds. This acquisition time, taken together with an estimated one hundred seconds for the climb and terminal dive maneuvers yields a total attack time of one hundred and eighty-five seconds. Assuming a total ingress time of about four hundred and twenty seconds, the estimated mission duration time for the low altitude search mode would therefore be about six hundred and five seconds.

The missile 10 carries a warhead 18 that is preferably detonated by a proximity fuze. The optimum burst point to maximize the probability of target destruction is determined by the warhead size, target characteristics, closing geometry, missile velocity, and fuze type. The imaging infrared image of the target is used to estimate target type and the closing geometry and missile velocity are used to assist the fuzing logic of warhead 18 to determine the optimum burst point. Lethality studies have indicated that a ninety-four pound fragmentation warhead in a missile having a terminal attack velocity of about eight hundred feet per second would provide an acceptable probability of target destruction.

Within its operating envelope, the radio frequency sensor's performance is not affected by weather conditions except for a slight loss of sensitivity due to ground signal attenuation. While the imaging infrared sensor's performance is reduced during adverse weather conditions, which significantly attenuate the propagation of infrared radiation, the missile 10 compensates for the reduced imaging capability by using a lower search altitude. Thus, the air defense destruction missile weapon system is capable of successfully conducting its mission in all weather conditions.

2. HUNTER-KILLER EMBODIMENT

The basic embodiment of the present invention, as previously described, integrates existing subsystems and advanced technologies to achieve an effective suppression of air defense sites and other types of sites of military interest. The invention in another embodiment includes a plurality of missiles 10 forming two cooperative teams of hunter missiles and killer missiles.

This embodiment provides a longer-term and potentially more cost effective system for suppressing air defense systems. The operational modes for the cooperative team of missiles 10 of the hunter-killer embodiment include the pre-briefed, pre-emptive, target-of-opportunity, and self-protection modes discussed above. In the hunter-killer embodiment, a carrier aircraft carries a plurality of missiles 10 that comprise the teams of hunter missiles and killer missiles, as for example two hunter missiles and eight killer missiles for a total of ten missiles.

The hunter missiles are the missiles 10 as described above, while the killer missiles are a less sophisticated, lower cost, version of the hunter missiles. The low observable airframe, propulsion system, warhead, guidance and control system, and Global Positioning System locating system are common to both hunter and killer missiles. The hunter missiles are each further equipped with a radio frequency direction finder and imaging infrared seeker, a stabilized laser designator, and a data link transmitter and receiver. The killer missiles are further equipped with a radar cross section augmentation system, a laser tracker, and a data link receiver.

The hunter missiles provide the data link, battle damage assessment, and target kill capabilities as previously described for the basic embodiment. However, since the killer missiles lack the radio frequency direction finder and imaging infrared seeker of the hunter missiles, they provide only a decoy capability to induce radiations from enemy air defense radars and the capability to attack and destroy air defense site targets. The inclusion of the laser designator on the hunter missiles enables the hunter missile to position a laser beam on the selected targets in response to pilot or weapon operator command. The killer missiles then attack the designated target using their laser trackers.

Non-emitting targets (e.g. missile launchers, generators, equipment vans, personnel carriers, etc.) within the same target site can thus be destroyed using the lower-cost killer missiles.

The hunter-killer embodiment also provides real time battle damage assessment of the attack through the imaging infrared imagery provided by the seekers of the hunter missiles.

3. DISTRIBUTED SYSTEM EMBODIMENT

The present invention is further embodied in a distributed system embodiment.

The operating modes of the distributed system embodiment include the pre-briefed, pre-emptive, target-of-opportunity, and self-protection modes of the basic embodiment. However, the distributed system embodiment provides for the pre-emptive and total destruction of an entire enemy surface-to-air missile site as a complement to the present High Speed Anti-Radiation Missile.

As previously indicated, a typical air defense site includes a radio frequency signal emitter, e.g., a radar antenna, as the primary target and non-emitting secondary targets such as missile launchers, generators, support vans, etc., as has been discussed above and illustrated in FIGS. 7–11.

The distributed system embodiment of the present invention provides for the destruction of the entire target site by means of concurrently surveying, searching, identifying, data linking, and attacking the selected target site using a cooperating team of missiles 10. The effectiveness of the distributed system embodiment does not rely solely on the detection and destruction of the radio frequency signal source as does the High Speed Anti-Radiation Missile, but rather destroys the air defense site by attacking all such primary and secondary targets concurrently.

The distributed system embodiment is comprised of a hunter missile and one or more killer missiles as has been previously described. The hunter missile, designed for target search, data link, battle damage assessment, and target kill, is preferably also equipped with a dual-mode synthetic aperture radar and laser radar seeker, a jam resistant Global Positioning Satellite locating system, and a jam resistant data link transmitter and receiver. Alternately, the seeker suite may be a dual-mode millimeter wave and laser radar seeker, a dual-mode synthetic aperture radar and imaging infrared seeker, or other acceptable multisensor target recognition systems known to those skilled in the art.

The killer missiles are equipped with a low-cost laser radar seeker or, alternately, an imaging infrared seeker, a Global Positioning System locating system, and a jam resistant data link transmitter and receiver. The killer missiles, as earlier described, are low-cost munitions designed to engage a variety of targets. The killer missiles may in another embodiment rely solely on the Global Positioning System locating coordinates provided by the hunter missile for terminal homing, thus eliminating the need for the laser radar seeker and further reducing the killer missile cost.

In another distributed system embodiment, one or more of the killer missiles carries a radar cross section augmentation system to induce enemy radar emissions, and radio frequency direction finders are provided on the killer missiles or the launching aircraft or both. Utilization of a plurality of low-cost munitions to engage all primary and secondary targets within a target site, with the pilots, weapon carriers, and carrier aircraft at a safe stand-off distance, makes the distributed system embodiment particularly cost effective and offering a high probability of target destruction.

The team of missiles of the distributed system embodiment can be launched from any of a plurality of existing carrier aircraft, such as the B-2 "Stealth" bomber, the F-16 or F/A-18 tactical fighters, or other aircraft at a stand-off distance of, for example, one hundred nautical miles or more. The team of missiles approaches a large target area, or "basket", cued by a remote system such as the Joint Surveillance Target Attack Radar System (J-STARS) or by on-board cuing from the carrier aircraft.

The distributed system embodiment is illustrated in FIGS. 14–17, showing sequentially the ingress to the target area, the excitation of radio frequency transmissions from defending radars, target search and identification, target engagement, and assessment of battle damage and mission completion and egress.

Figure 14:
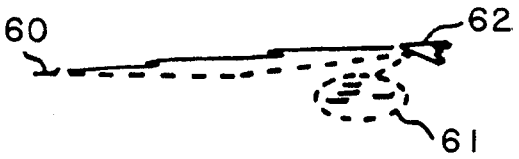
FIG. 14 is a perspective view illustrating the penetration and launch phases of an air defense suppression mission performed using the present invention.

As shown in FIG. 14, the hunter missile 60 and the killer missiles 61 of the distributed system embodiment are launched from, for example, a B-2 bomber 62 and enter the air defense target area at a cruise altitude of, for example, at least forty thousand feet above ground level from the stand-off launch position. During the mission ingress phase, the active seekers of missiles 60, 61 are dormant and the missiles 60, 61 fly to the target "basket" using known Global Positioning System coordinates of the target sites as represented by radar 42 and missile launchers 48.

It will be understood that the known coordinates of the targets are in general imprecise, and that the target location may change. The missiles 60 and 61 are protected through the use of low observables technology and other survivability enhancement technologies known to those skilled in that art.

Upon arrival at the target area, the hunter missile 60 loiters at a high altitude for surveillance purposes and initiates a wide-area target search. One or more killer missiles 61, following the hunter missile 60 at a distance, descend to a search-and-kill low altitude. Target confirmation and destruction is achieved by using the laser radar seeker of the missile 61 at low altitudes.

It is also noted that the Joint Surveillance Target Attack Radar System at a large stand off distance may also serve as a high-altitude target identification source, providing target information to the hunter missiles 60 or killer missiles 61, or alternatively to other low-altitude weapon systems such as armed helicopters or attack fighters or fighter-bombers directly or through the crew of B-2 bomber 62.

The hunter missile 60 cruises at the designated high altitude using a pre-programmed search and surveillance pattern. The hunter missile 60 includes a side-mounted synthetic aperture radar seeker, which provides search, surveillance and detection of the target area through wide-area mapping of potential targets at high altitude. The on-board radio frequency direction finder of hunter missile 60 provides targeting information for the radar 42 should it radiate, thus enabling fast determination of the positions of radars 42 and missile launchers 48 for attack.

The automatic target recognition algorithms of hunter missile 60 autonomously recognize the potential target sites and marks the Global Positioning System locations of these target sites. The radar images of the target site are digitally encrypted and data linked to the pilot, if desired.

In another embodiment, the target location data is transmitted from satellite systems or other remote intelligence platforms. Using on-board radio frequency direction finders, the pilot or weapon operator of B-2 bomber 62 may optionally redirect the search-and-attack mission of the distributed system embodiment of the invention by providing updated Global Positioning System target coordinates to hunter missiles 60 and killer missiles 61. The updated Global Positioning system target locations are data linked to the killer missiles 61 for target engagement at low altitude.

Figure 15:
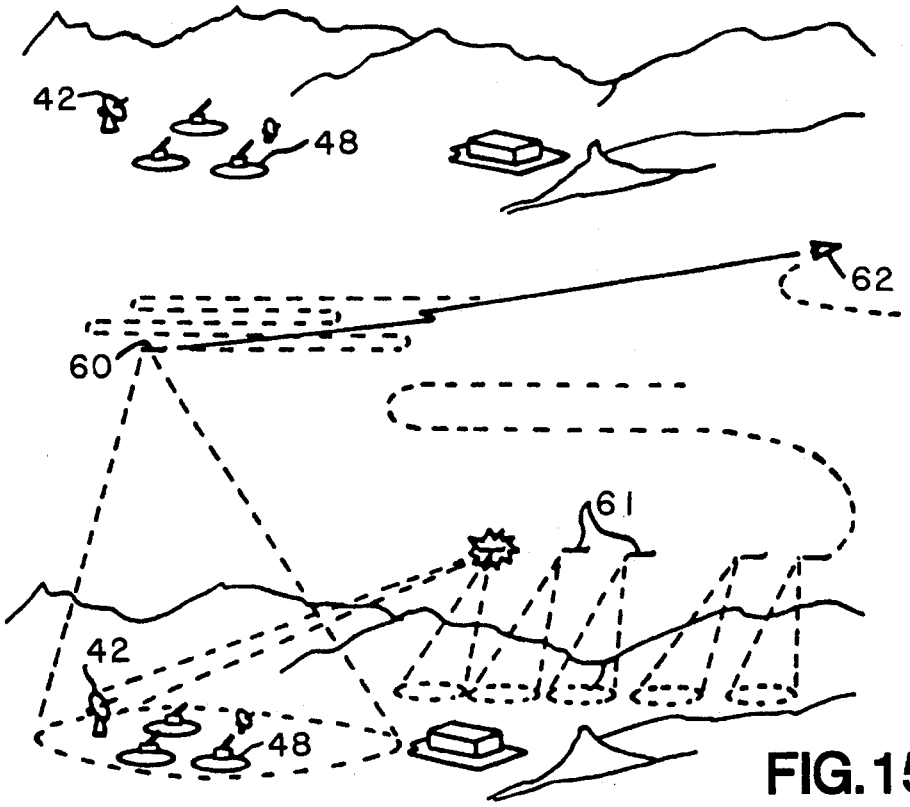
FIG. 15 is a perspective view illustrating the target search and identification phases of the mission shown in FIG. 14.

The killer missiles 61 fly toward the target areas and search for the target or targets selected and laser-designated for attack using their respective downward looking laser radar seekers at low altitude, as shown in FIG. 15. The target images and Global Positioning System target locations are uplinked to the pilot or weapon operator of B-2 bomber 62 by hunter missile 60 for review, target confirmation, prioritization, and command of attack. The killer missiles 61 then engage the laser-designated targets autonomously or upon pilot or weapon operator command from B-2 bomber 62.

In another embodiment, a dual-mode seeker concept for the hunter missiles 60 employs a forward looking millimeter wave seeker for slant range scanning and a downward looking laser radar seeker for identification of the targets. In this case, the hunter missiles 60 cruise at a lower altitude, as for example less than eight thousand feet above ground level.

The previously described operations of target recognition and confirmation, namely target cuing, search detection, close identification, and final confirmation, coupled with high warhead effectiveness, provide for a very high probability of target destruction of either fixed or mobile targets. This approach provides the pilot or weapon operator of B-2 bomber 62 or other carrier aircraft with a visual display of target engagement by means of the digital imagery from the killer missile 61.

Figure 16:
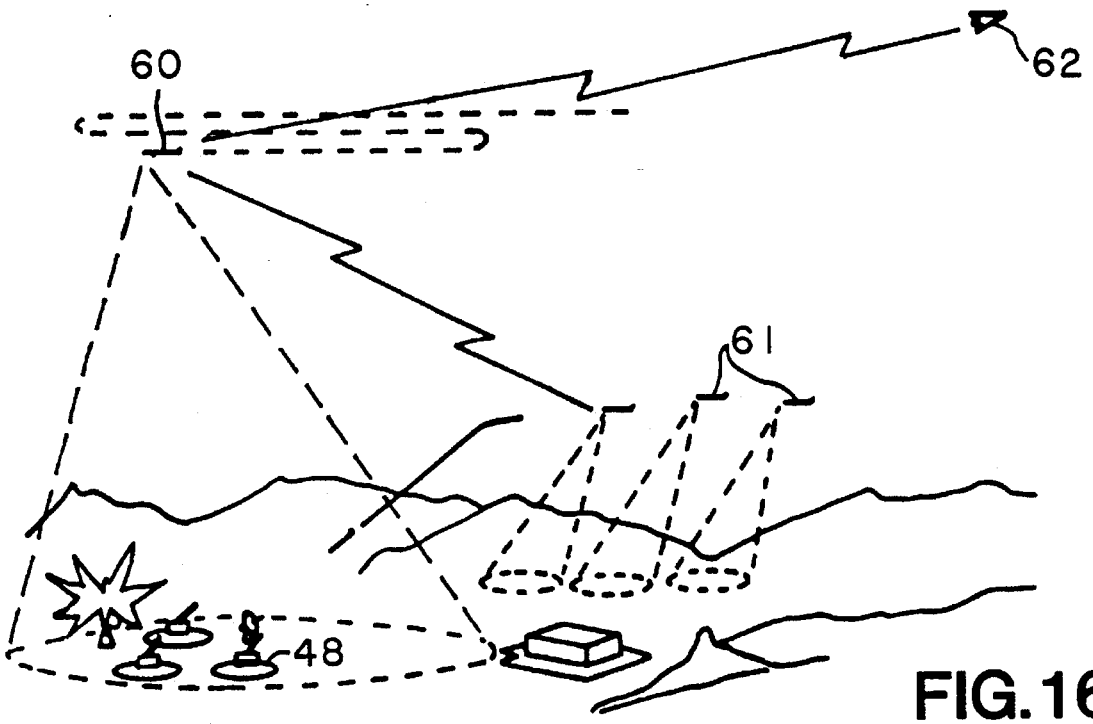
FIG. 16 is a perspective view illustrating the target engagement phase of the mission shown in FIGS. 14 and 15.

FIG. 16 illustrates the phase of the attack by the distributed system embodiment of the invention where the high altitude hunter missile 60 has located the target site and the group of low altitude killer missiles 61 have engaged the target by destroying one missile launcher 48 and are in the process of searching for other facilities and equipment at the target site to attack. Hunter missile 60 provides battle damage assessment during this phase of the attack by means of the data link transmittal of digital imagery of the attack to B-2 bomber 62.

Figure 17:
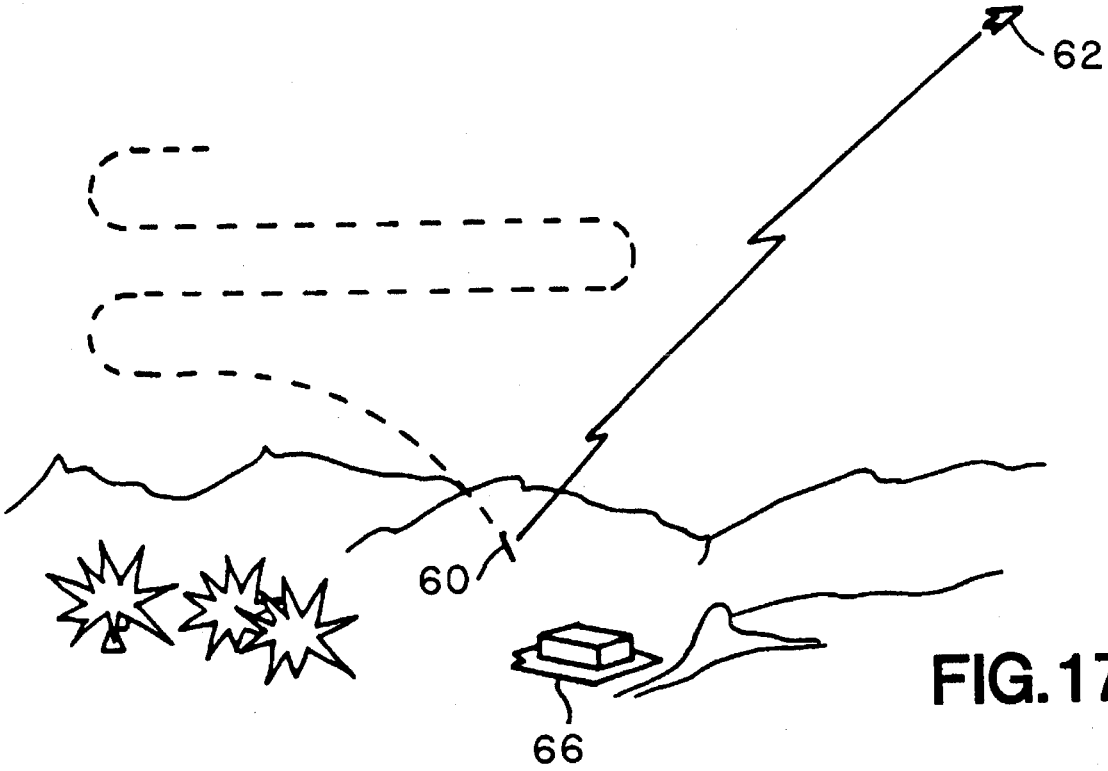
FIG. 17 is a perspective view illustrating the battle damage assessment and final attack of a high value target for the mission shown in FIGS. 14, 15, and 16.

FIG. 17 illustrates the final phase of the attack by the distributed system embodiment. There, killer missiles 61 have destroyed all targets within the target air defense site area and hunter missile 60 is shown as attacking a high value target facility 66, such as a command center, which had been previously defended by the radar 42 and surface-to-air missile launchers 48. B-2 bomber 62 is shown as departing from its stand-off launch position to egress the area and return to its base. While egressing, B-2 bomber 62 continues to receive attack information from hunter missile 60 by data link until hunter missile 60 is itself destroyed with target facility 66.

In another embodiment, the higher value hunter missile 60 may be commanded to exit the target area and deploy a parachute for subsequent recovery. Such an embodiment preserves the higher-cost hunter missile 60 for re-use in subsequent missions.

4. MODIFIED SYSTEM EMBODIMENT

Figure 18:
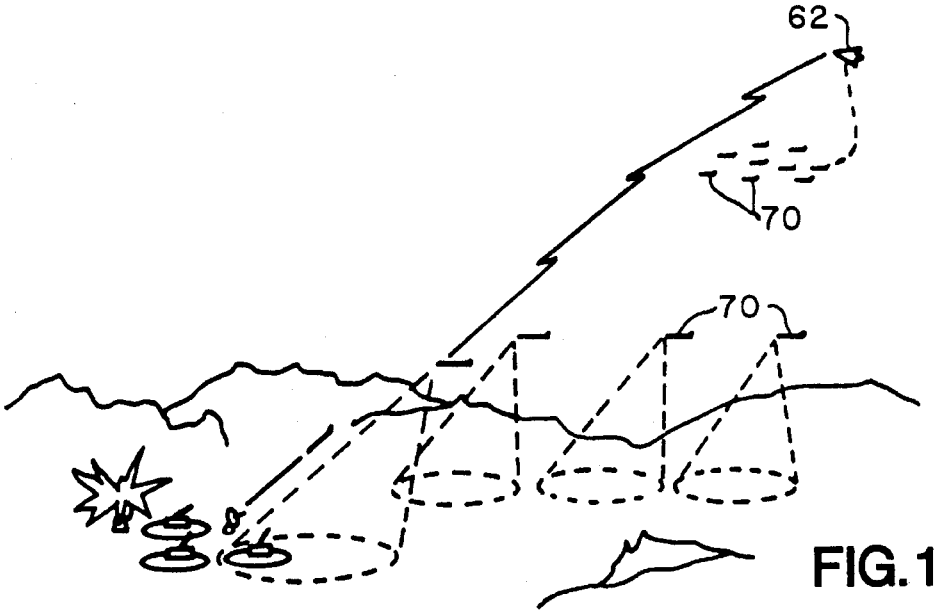
FIG. 18 is a perspective view of the modified system embodiment of the present invention; and, FIG. 19 is a perspective view of the interoperability system embodiment of the present invention.

The present invention may also be incorporated into a wide variety of existing weapon systems by modification thereto as illustrated in FIG. 18 and described below.

There presently exists a number of existing missile systems that are capable of sustained cruise, surveillance, loitering, and gliding flight. These existing missile systems are also adapted for delivery by various currently existing fighters and bombers.

In the modified system embodiment of the invention, one or more existing missiles are modified to incorporate into each of such missiles a laser radar seeker or, alternatively, an imaging infrared seeker, or a suitable dual-mode seeker as has been described above. Optionally, but preferably, a radio frequency direction finder, a Global Positioning System locating system, a missile-to-aircraft data link, and survivability enhancement features and low observable technologies are also incorporated. In some cases, the existing missile airframe may need to be modified to accommodate the additional systems and components of the modified system embodiment.

As shown in FIG. 18, modified missiles 70 of the modified system embodiment are cued to the target "basket" by target intelligence information such as the Joint Surveillance Target Attack Radar System in the manner discussed for the preceding embodiments. Upon arrival at the designated target location, the missiles 70 descend to a low altitude, such as of less than five thousand feet above ground level, to perform search detection, close identification, confirmation of targets, and terminal engagement.

The modification of existing missiles to incorporate the present invention is a cost-effective alternative to the development of a new missile airframe. In addition, the modified system embodiment can be used by itself for the search and detection of enemy targets in lieu of manned reconnaissance aircraft and similar intelligence sources. Once the targets have been identified and located, target data can be data linked to conventional attack aircraft such as fighters and bombers for subsequent attack by those aircraft. This concept is embodied in yet another embodiment of the present invention as described below.

5. INTEROPERABILITY SYSTEM

Figure 19:
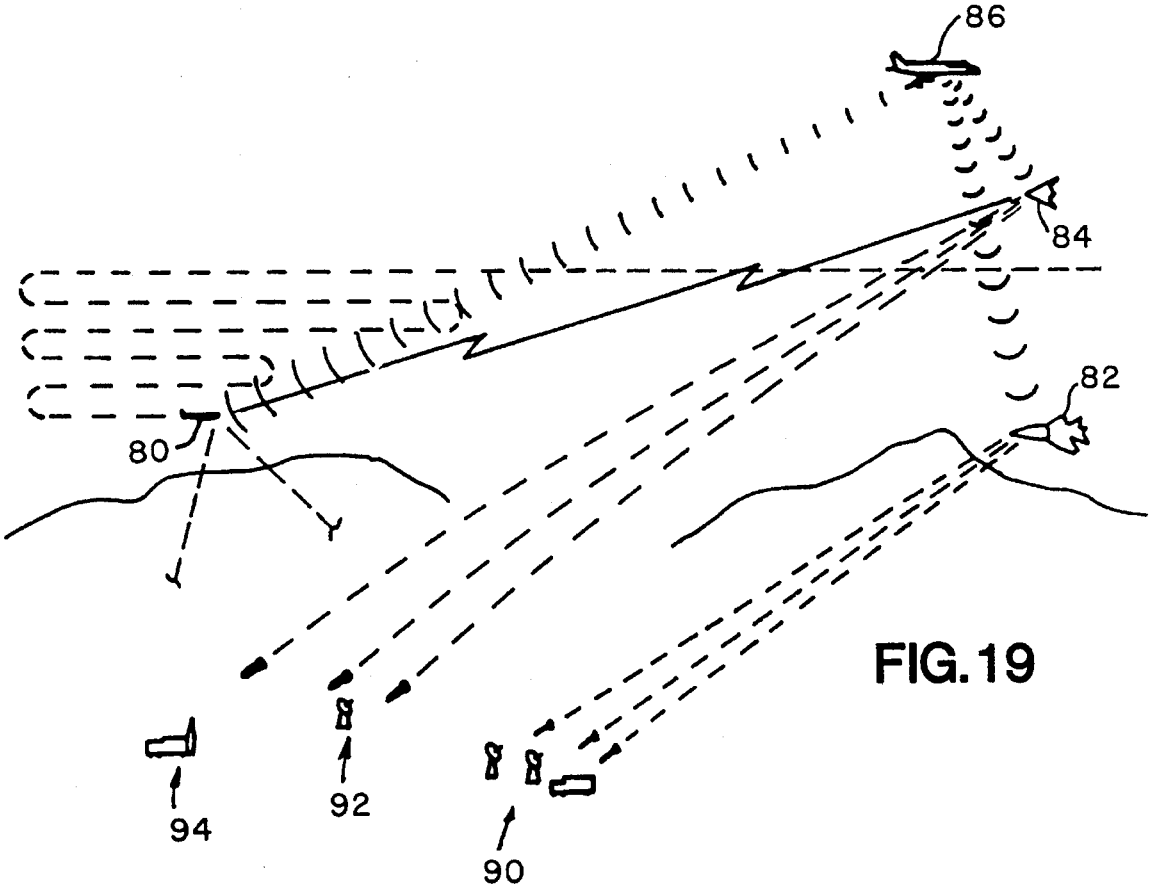

A further embodiment of the invention, referred to hereafter as the interoperability system embodiment, is shown in FIG. 19. Instead of destroying the targets using the missiles as in the previous embodiments, the interoperability system embodiment exploits the combined capabilities of the plurality of carrier aircraft and missiles of the present invention.

In the embodiment of FIG. 19, carrier aircraft 82, 84 are the killers whereas the missile 80 is the hunter. The missile 80 performs high altitude ingress, penetration, surveillance search, identification, data link data transmission, and targeting of the mobile radar site 90, radar 92 and other potential targets such as mobile ballistic missile launchers 94, and other targets of military interest whereas the carrier aircraft 82, 84 engage the targets by delivering existing, low-cost weapons such as conventional gravity bombs or precision weapons to those targets. The interoperability system embodiment further provides for the exchange of critical threat information over real-time data links, and reduces the size, cost, and complexity of the avionic systems and subsystems on the carrier aircraft 82, 84 and enhances the capability and survivability of the carrier aircraft 82, 84 by significantly improving the awareness of their respective aircrews as to the military situation in the target area.

Similar to the missiles 60 of the distributed system embodiment, the missile 80 of the interoperability system embodiment is a low observable missile or other similar surveillance/cruise/loitering/glide missile. The missile 80 is modified to carry off-the-shelf subsystems and advanced sensors as described for previous embodiments which enable surveillance, search, identification, data link, and targeting.

Preferably, missile 80 of the interoperability system embodiment is equipped with synthetic aperture radar and imaging infrared surveillance sensors or other comparable multisensor target recognition systems such as the combination of forward looking infrared day and night video, a synthetic aperture radar, an imaging infrared direction finder, a jam resistant Global Positioning System locating system, and one or more jam resistant data link transmitter and receiver systems. The missile 80 is also preferably provided with survivability enhancement technology and other low observable features and may be parachute recoverable.

After launching missile 80, its carrier aircraft, shown in FIG. 19 by way of example as a B-2 bomber aircraft 84, serves as a killer strike aircraft. It will be appreciated that the carrier aircraft can also include any fighter aircraft which carries conventional guided or unguided bombs or missiles, shown for example in FIG. 19 as an F/A-18 aircraft 82.

A significant advantage of the interoperability system embodiment is that it integrates existing missiles, off-the-shelf technologies, carrier aircraft, and available low-cost munitions to form an integrated target destruction system which is highly affordable since no new weapon needs to be developed. The low-observable airframe for the missile 80 of this embodiment is survivable and is recoverable. The interoperability embodiment system of the present invention is a true "force multiplier" as it effectively and affordably suppresses an enemy's entire target air defense system site, provides real time battle damage assessment capability, significantly improves pilot situation awareness, and reduces aircrew and aircraft risk by delivering weapons from a substantial standoff range.

The missile 80 is cued to the target area by a suitable remote intelligence system, such as the Joint Surveillance Target Attack Radar System aircraft 86 or by commands from the carrier aircraft 84. Missile 80 penetrates to the target area in a low observable mode of flight (i.e., with radar and other active sensors quiescent) and at a cruise altitude of, for example, above forty thousand feet above ground level. The carrier aircraft 84 maintains a safe stand-off distance from the target area and approaches the stand-off location using an evasive route selected to minimize the possibility of being detected.

The missile 80 thus provides forward surveillance and real-time situation awareness data to the crews of the carrier aircraft 84. Upon arrival at the target, the missile 80 descends to an altitude of, for example, about fifteen thousand feet above ground level and initiates a wide-area target surveillance and search. After identification of potential targets such as mobile radar site 90, radar 92 and mobile ballistic missile launchers 94, the missile 80 transmits sensor images and Global Positioning System target coordinates of the targets to the carrier aircraft 84.

Upon confirmation of the targets, the carrier aircraft 84 becomes a killer strike aircraft, and attacks the selected targets. The pilot or weapon operator of carrier aircraft 84 selects the attack tactics and weapons to be used from those weapons carried aboard carrier aircraft 84. By way of example, the pilot or weapon operator may "ripple drop" a number of conventional, unguided gravity bombs or use "smart" precision-guided munitions in response to the target information obtained from the sensor imagery provided by the missile 80. The pilot or weapon operator may alternatively choose to deliver a large number of lower-cost munitions, such as low-drag gravity bombs or bomblet dispensers for the wide area destruction of enemy assets, or to deliver a lesser number of higher-cost, more accurate, terminally self-guiding, ordnance weapons for use against tanks or other armored vehicles.

The use of missile 80 to provide forward surveillance together with the large variety of weapons which are deliverable by the carrier aircraft 84 maximizes the likelihood of target destruction, and minimizes mission costs and risk of loss of aircraft and crew.

After the attack the missile 80 subsequently provides battle damage assessment through transmission of digital imagery from its sensors to carrier aircraft 84, and is used to destroy residual targets as designated by the pilot or weapon operator of carrier aircraft 84. As a cost saving measure, the missile 80 can in another embodiment be commanded to return to the standoff location or other safe position for subsequent parachute recovery by a recovery vehicle (not shown).

It will also be appreciated that the selected targets to be attacked my be engaged by a second killer aircraft, as for example F/A-18 carrier aircraft 82, while the B-2 bomber carrier aircraft 84 remains at the safe stand-off position. Also, the target may be simultaneously attacked by both carrier aircraft 82, 84 where appropriate under the specific tactical circumstances of the mission.

The above described embodiments of the invention provide for the engagement of a large variety of targets using a variety of weapons and systems which enhance air superiority and survivability of the carrier aircraft and its crew. The invention thus provides a cost effective and novel system for the surveillance, and search for, and identification, and engagement, and destruction of and destruction of air defense system targets or other target sites of military interest.

A wide variety of modifications and improvements to the invention described herein are believed to be apparent to those skilled in the art. Accordingly, no limitation on the present invention is intended by way of the description herein, except as set forth in the appended claims.

What is claimed is:

1. A method of destroying a military target site, comprising the steps of:

launching a plurality of missiles from an aircraft at a stand-off range from a target area, each said missile having an airframe, means for propulsion of said missile, and control surfaces, at least one of said missiles being a hunter missile adapted to include a radio frequency direction finder, an imaging infrared seeker system with automatic target cuing algorithms, an on-board Global Positioning System locating system, a jam-resistant data link system for transmitting and receiving data between said hunter missile and said aircraft and between said hunter missile and other command and control platforms and receiving stations, a radar cross section augmentation system, a laser target designator, and a warhead, at least one of said missiles being a killer missile adapted to include an on-board Global Positioning System locating system, a radar cross section augmentation system, a laser tracker, a jam-resistant data link receiver, and a warhead;

deploying said plurality of missiles to said target area;

operating said radar cross section augmentation system of at least one of said plurality of missiles to induce emissions of radio frequency energy from said military target site;

operating said radio frequency direction finder and said automatic target cuing algorithms of said imaging infrared seeker system of said hunter missile to survey, locate and select a target of said military target site for destruction;

directing a selected one of said killer missiles to said selected target; and, detonating said warhead at said selected target.

2. The method according to claim 1 wherein said military target site is an air defense system site.

3. An air defense destruction missile weapon system comprising:

a carrier aircraft; and, at least one missile adapted for launch from said carrier aircraft, each said missile having an airframe, means for propulsion, a plurality of control surfaces, a radio frequency direction finder, an imaging infrared seeker system with automatic target cuing algorithms, an on-board Global Positioning System locating system, a jam-resistant data link system for transmitting and receiving data between said hunter missile and said carrier aircraft and between said hunter missile and other command and control platforms and receiving stations, a radar cross section augmentation system, and a warhead.

4. A method of destroying a military target site, comprising the steps of:

launching a plurality of missiles from an aircraft at a stand-off distance from said military target site, each said missile having an airframe, means for propulsion of said missile, and control surfaces, at least one of said missiles being a hunter missile having a multisensor target surveillance and recognition system, an on-board jam resistant Global Positioning System locating system, a jam resistant data link system for transmitting and receiving data between said hunter missile and said carrier aircraft and between said hunter missile and other command and control platforms and receiving stations, a laser target designator, and a warhead, at least one of said missiles being a killer missile having an on-board Global Positioning System locating system, a laser tracker, a jam resistant missile-to-aircraft data link receiver, and a warhead;

deploying said missiles to said military target site;

operating said multisensor target surveillance and recognition system of said hunter missile to survey, identify and locate targets of said military target site;

transmitting target information for said identified and located targets over said missile-to-aircraft data link to said aircraft;

laser designating selected targets of said identified and located targets for attack; and, directing a respective one of said killer missiles to a respective one of said selected targets; and, exploding said warhead at said respective one of said selected targets.

5. The method of claim 4 wherein said multisensor target surveillance and recognition system of said hunter missile is a radio frequency direction finder and an imaging infrared seeker.

6. The method of claim 4 wherein said multisensor target surveillance and recognition system of said hunter missile is a dual mode synthetic aperture radar and laser radar seeker.

7. The method of claim 4 wherein said multisensor target surveillance and recognition system of said hunter missile is a dual mode millimeter wave and laser radar seeker.

8. The method of claim 4 wherein said multisensor target surveillance and recognition system of said hunter missile is a dual mode synthetic aperture radar and imaging infrared seeker.

9. The method of claim 4 wherein each said killer missile further includes a laser radar.

10. The method of claim 4 wherein each said killer missile further includes a radar cross section augmentation system.

11. The method of claim 4 wherein each said hunter missile is deployed at an altitude substantially higher than an altitude at which each said killer missile is deployed.

12. The system according to claim 4 wherein said military target site is in air defense system site.

13. An aircraft defense destruction missile weapon system comprising:

a carrier aircraft; and, at least one air defense destruction missile adapted for launch from said carrier aircraft, each said missile having an airframe, means for propulsion of said missile, control surface means for controlling flight of said missile, a multisensor target surveillance and recognition system, an on-board Global Positioning Satellite locating system, a jam resistant data link system for transmitting and receiving data between said hunter missile and said carrier aircraft and between said hunter missile and other command and control platforms and receiving stations, a radar cross section augmentation system, and a warhead.

14. The system of claim 13 wherein said multisensor target surveillance and recognition system of said missile comprises a radio frequency direction finder and an imaging infrared seeker.

15. The system of claim 13 wherein said multisensor target surveillance and recognition system of said missile comprises a dual mode synthetic aperture radar and laser radar seeker.

16. The system of claim 13 wherein said multisensor target surveillance and recognition system of said missile comprises a dual mode millimeter wave and laser radar seeker.

17. The system of claim 13 wherein said multisensor target surveillance and recognition system of said missile comprises a dual mode synthetic aperture radar and imaging infrared seeker.

* * * * *